US007000768B2

(12) United States Patent
Morita et al.

(10) Patent No.: US 7,000,768 B2
(45) Date of Patent: Feb. 21, 2006

(54) CASE FOR A PRESS-THROUGH PACKAGE

(75) Inventors: Makoto Morita, Toyama (JP); Shinsuke Watanabe, Toyama (JP); Tetsuo Oida, Toyama (JP); Masahito Tanaka, Osaka (JP); Yasunori Akimura, Osaka (JP)

(73) Assignees: Asahi Printing Co., Ltd., Toyama (JP); Kanae Co., Ltd., Osaka (JP)

( * ) Notice: Subject to any disclaimer, the term of this patent is extended or adjusted under 35 U.S.C. 154(b) by 120 days.

(21) Appl. No.: 10/814,471

(22) Filed: Mar. 30, 2004

(65) Prior Publication Data

US 2005/0077203 A1 Apr. 14, 2005

(30) Foreign Application Priority Data

Mar. 31, 2003 (JP) ..... 2003-094034

(51) Int. Cl.
*B65D 83/04* (2006.01)

(52) U.S. Cl. ..... 206/531; 206/538

(58) Field of Classification Search ..... 206/528, 206/531–534, 538–539, 462, 463, 468
See application file for complete search history.

(56) References Cited

U.S. PATENT DOCUMENTS 6,394,275 B1 * 5/2002 Paliotta et al. ..... 206/531
6,659,280 B1 * 12/2003 Paliotta et al. ..... 206/531
6,675,972 B1 * 1/2004 Patterson ..... 206/531
6,726,015 B1 * 4/2004 Hulick ..... 206/531
6,848,580 B1 * 2/2005 Paliotta et al. ..... 206/531
6,896,138 B1 * 5/2005 Rock et al. ..... 206/531

FOREIGN PATENT DOCUMENTS

JP 10-059415 3/1998

* cited by examiner

*Primary Examiner*—Luan K. Bui
(74) *Attorney, Agent, or Firm*—Fulbright & Jaworski LLP

(57) ABSTRACT

A PTP case with at least one blister with one or more pills therein is disclosed. The PTP case includes: a first sheet member having at least one accommodation hole for accommodation of the at least one blister; a second sheet member having at least one take-out hole located corresponding to the at least one accommodation hole of the first sheet member, in which the press-through package is placed between the first and second sheet members so that the one or more pills is taken out from the at least one blister through the at least one take-out hole; and a blocking sheet member disposed between the PTP and the second sheet member in such a manner as to be slidable along the PTP and the second sheet member between an opening position at which the at least one take-out hole is exposed to the outside, and a closing position at which the at least one take-out hole is closed by the blocking sheet member. The first and second sheet members respectively have elongated holes located corresponding to each other so as to make the blocking sheet member to the outside through the elongated holes.

6 Claims, 4 Drawing Sheets

CASE FOR A PRESS-THROUGH PACKAGE

CROSS REFERENCE TO RELATED APPLICATION

This application claims priority from Japanese Patent Application No. 2003-094034, which is incorporated herein by reference.

BACKGROUND OF THE INVENTION

1. Field of the Invention

The present invention relates to a case for a press-through package that is commonly used as a package for enclosing medication, pills or any other solid medicines in a pharmaceutical packaging industry.

2. Related Art

As described in Japanese Patent Application Laid-open No. Hei-10-59415, a conventional case for a press-through package (hereinafter simply referred to a PTP) or blister package, as illustrated in FIG. 4, is made up of a sheet that is folded into two leaves 1*a*, 9*a*, thereby providing therebetween a space for a PTP 2*a*. The case is held in a folded state with the PTP 2*a* therein. The first leave 1*a* has accommodation holes 4*a* for accommodation of flexible blisters or bubbles 3*a* (hereinafter referred only as blisters 3*a*) formed on a sheet made of typically a transparent plastic material of the PTP 2*a*, each blister forming separate compartment for one or more pills, while the second leave 9*a* has take-out holes 11*a* located corresponding to the accommodation holes 4*a* or the blisters 3*a*, through which the pills are pressed to the outside. Precautions, descriptions, medication administration records or other information are printed on the surface of each leave 1*a*, 9*a* so as to allow a patient, doctor or pharmacist to obtain the relevant information in a reliable manner.

The description hereinafter will be made by taking for example the case where each blister contains one pill. Accordingly, when referring to the position of each blister, the position as referred also represents the position of each pill contained therein, and vice versa. The drawings are also illustrated in the same manner as the description.

When each pill is taken out from each corresponding blister 3*a* of the PTP 2*a*, a pressure is applied onto the blister 3*a* from the first leaf side, thereby pressing the pill outward, which pressure causes rupture of an aluminum foil or paper sheet, which has been attached to the sheet with the blisters formed therein, and hence pressing the pill out from the blister 3*a*.

The PTP case of the above type easily allows pills to be taken out only by application of pressure onto the blisters 3*a*. This may pose a serious problem that a child or careless adult is highly likely to accidentally swallow them if the PTP case is stored or left in a place easy to access for them.

Another problem is accidental rupture of a foil or sheet of a PTP upon unintentional pressure during the transportation, resulting in exposure of the pills to the outside or falling out of the pills from the PTP through the take-out holes 11*a* located corresponding to the blisters with the pills therein.

Accordingly, it is an object of the present invention to provide a PTP case that is designed to limit the access to medicines or pills contained in a PTP or the like and hence make a child hard to access to them, thereby contributing to proper administration and safe storage.

SUMMARY OF THE INVENTION

According to the present invention, there is provided a PTP case with at least one blister with one or more pills therein, which includes: a first sheet member having at least one accommodation hole for accommodation of the at least one blister; a second sheet member having at least one take-out hole located corresponding to the at least one accommodation hole of the first sheet member, in which the press-through package is placed between the first and second sheet members so that the one or more pills is taken out from the at least one blister through the at least one take-out hole; and a blocking sheet member disposed between the PTP and the second sheet member in such a manner as to be slidable along the PTP and the second sheet member between an opening position at which the at least one take-out hole is exposed to the outside, and a closing position at which the at least one take-out hole is closed by the blocking sheet member. The first and second sheet members respectively have elongated holes located corresponding to each other so as to make the blocking sheet member to the outside through the elongated holes.

According to the PTP case of the above arrangement, the blocking sheet member is placed between the PTP and the second sheet member in a slidable manner, thereby opening and closing the take-out hole of the second sheet member. The elongated holes of the first and second sheet members, through which the blocking sheet member is expose to the outside, are located corresponding to each other. Accordingly, as long as the take-out hole is closed by the blocking sheet member, the pill or pills inside of the blister is unlikely to be taken out from the PTP. In addition, the sliding of the blocking sheet member is achieved by holding the blocking sheet member through the elongated holes with fingers of one hand, while holding the PT' case with fingers of another hand. Accordingly, it is not easy for a child to achieve this sliding action. As a result, it is possible to prevent accidental swallowing of pills by a child or the like and keep the pills in secure storage under control and proper administration of pills.

In the PTP case, the distance between an outer periphery of an accommodation-hole forming section with the at least one accommodation hole therein and a first end of the first sheet member may be set to be wide. Also, the distance between an outer periphery of a take-out hole forming section with the at least one take-out hole therein and a first end of the second sheet member may be set to be wide. In this arrangement, the elongated hole of the first sheet member may also be located closer to the outer periphery of the accommodation-hole forming section than to the first end of the first sheet member. And, the elongated hole of the second sheet member may be located closer to the outer periphery of the take-out hole forming section than to the first end of the second sheet member. Accordingly, with these distances set in consideration of the size of a child's hand, it is possible to make a child harder to take out the pills from the PTP.

A cover may be detachably attached to any one of the first and second sheet members so as to partially or entirely cover a corresponding one of the elongated holes. Or, covers may be detachably attached respectively to the first and second sheet members so as to partially or entirely cover the elongated holes. As long as the elongated hole or elongated holes are held in closed state by the cover or covers, any illegal action applied onto the pills in an attempt to falsely replace the pills with improper pills or medicines, or the like can be prevented. Thus, the pills can be kept in secure storage under control.

The thus arranged PTP case is usually held in a state with the at least one take-out hole closed by the blocking sheet member. When in use, that is, the pills are to be taken out from the PTP, the blocking sheet member exposed to the outside through the elongated holes of the first and second sheet members is held with fingers of one hand while holding the PTP case with fingers of another hand. Then the blocking sheet member is slid to the opening position. With this positioning, a pressure is applied onto the blister so that pill or pills therein are pressed out through the take-out hole. When the take-out hole is to be closed, the blocking sheet member is reversely slid to the original position or closing position.

At least one of the first and second sheet members may have a cut-away portion, through which an end of the blocking sheet member in the sliding direction thereof is exposed to the outside, when the blocking sheet member is slid to the opening position. With this arrangement, when the blocking sheet member is to be returned to the original position or closing position, it can be achieved by pressing the exposed end of the blocking sheet member inward. This arrangement also contributes to prevention of accidental swallowing of pills and secure storage of the pills under control.

Also, another advantage of the present invention is to prevent accidental falling-out of pills from the PTP with unintentional pressure during the transportation since the take-out hole is usually closed by the blocking sheet member.

BRIEF DESCRIPTION OF THE DRAWINGS

The above, and other objects, features and advantages of the present invention will become apparent from the detailed description thereof in conjunction with the accompanying drawings wherein.

DESCRIPTION OF THE PREFERRED EMBODIMENTS

Embodiments of the case for a PTP (hereinafter referred to a PTP case) according to the present invention will be herein described with reference to the drawings attached hereto.

Figure 1:
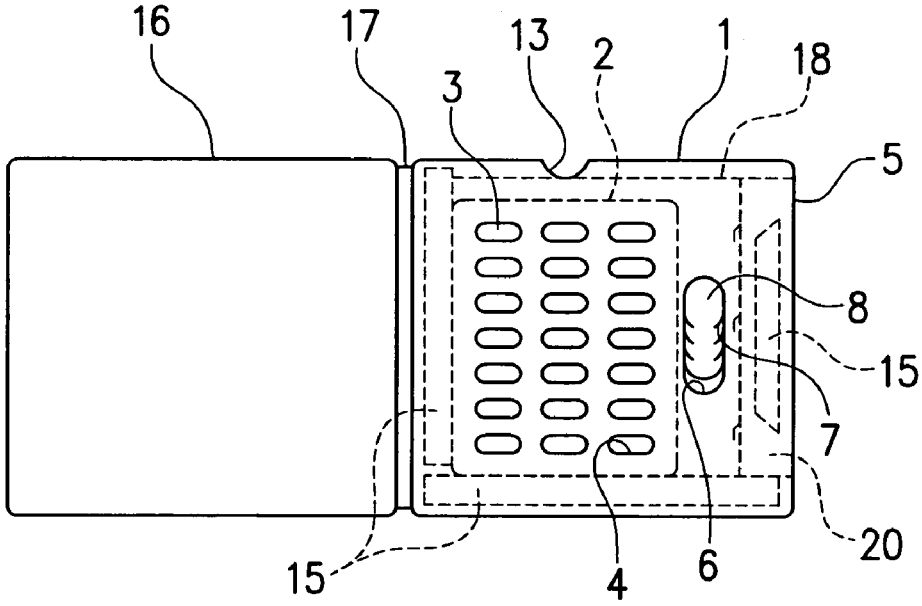
FIG. 1 is a front view of a PTP case according to an embodiment of the present invention.
Figure 2:
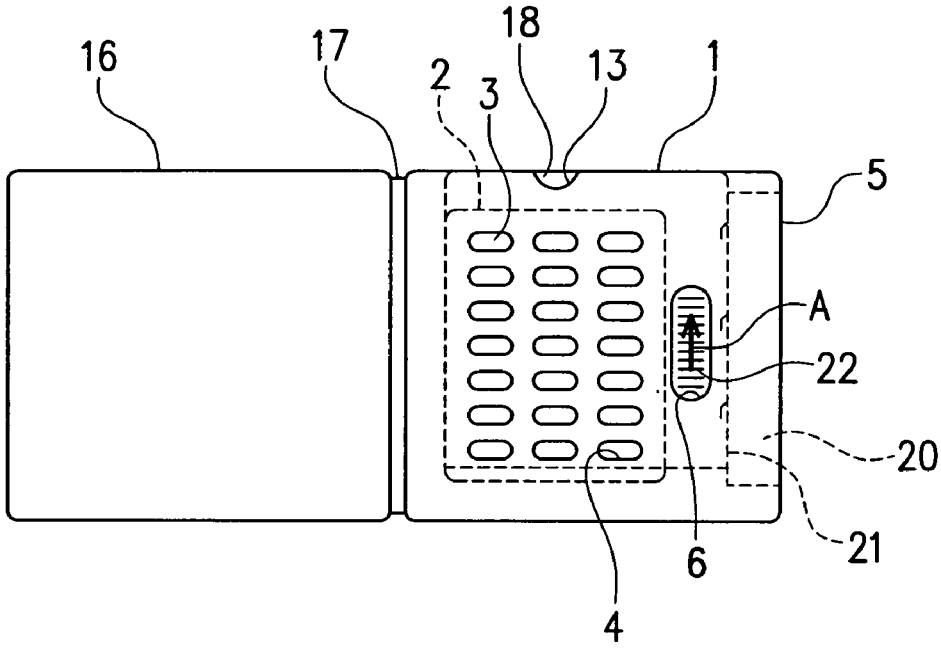
FIG. 2 is a front view of the PTP case when in use.
Figure 3:
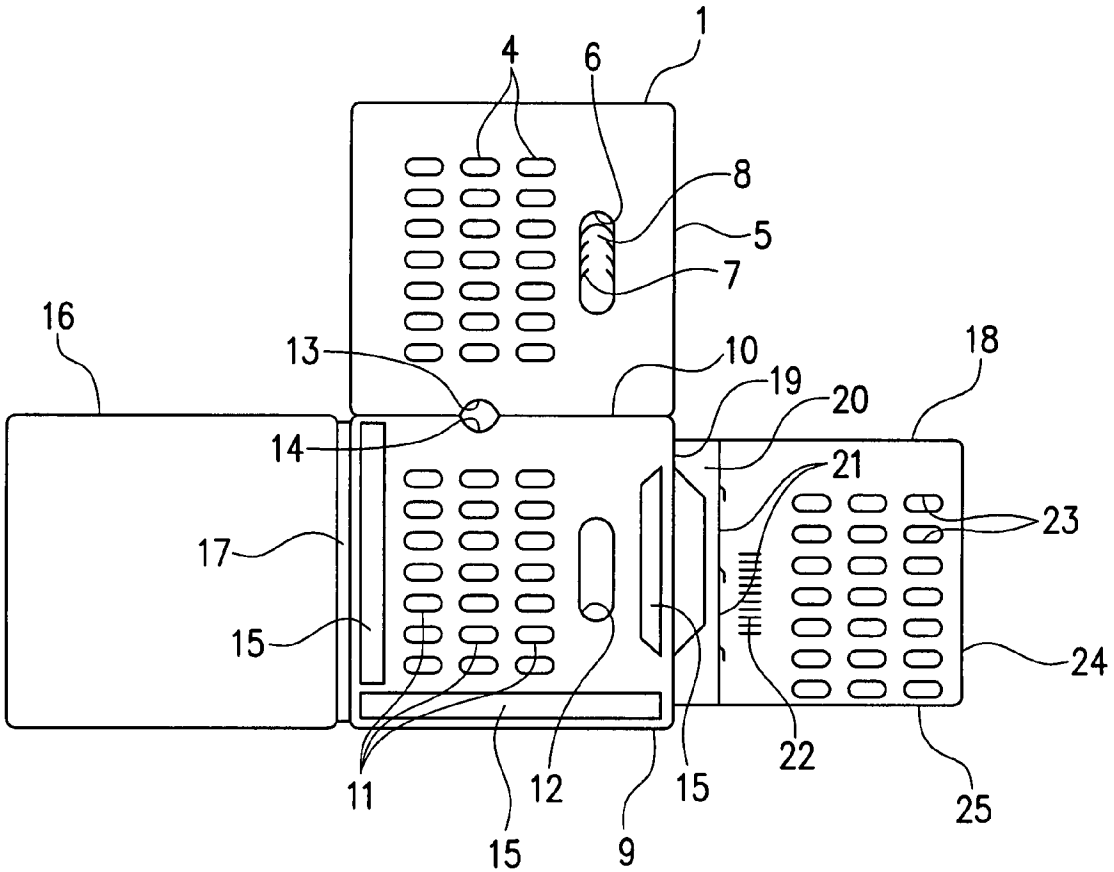
FIG. 3 is a development view of the PTP case.
Figure 4:
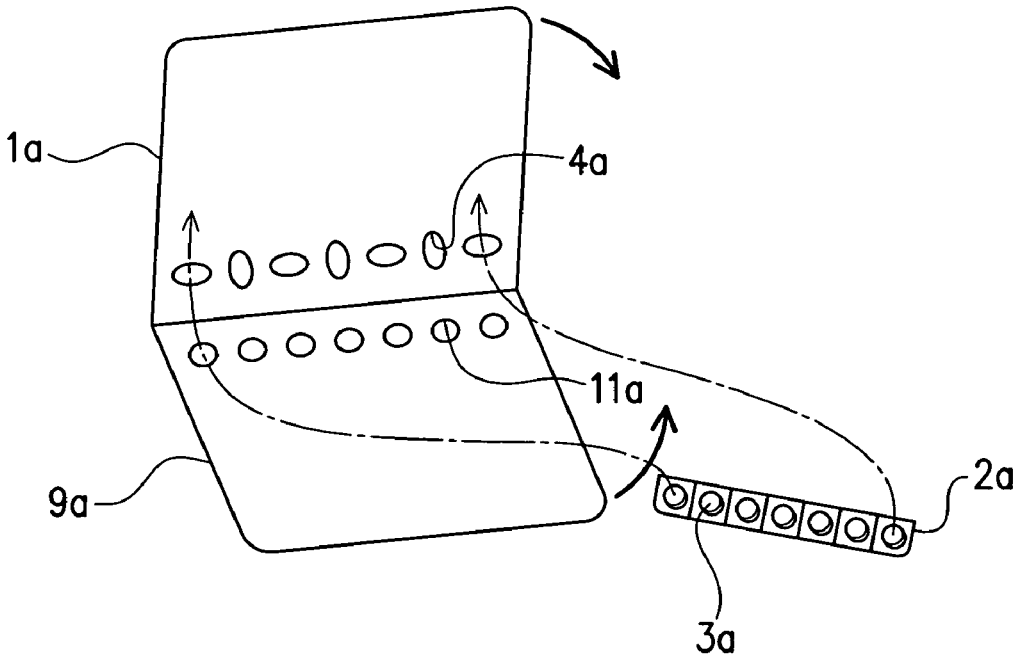
FIG. 4 PRIOR ART
FIG. 4 is a perspective view of a conventional PTP case.

As illustrated in FIGS. 1–3, a first sheet member 1 has an accommodation-hole forming section with plural accommodation holes 4 for accommodation of blisters each containing one or more pills therein in a PTP 2. As described above, the description will be made by taking for example the case where each blister contains one pill, and accordingly the term "pill" is replaceable with the term "blister" throughout the description when referring to the position thereof, and specifically a pill 3 herein used is meant as a blister with the pill 3 therein when referring to the position thereof.

The distance between an outer periphery of an accommodation-hole forming section with the accommodation holes therein and a first end 5 of the first sheet member 1 is set to be wider than the distance between the outer periphery of the accommodation-hole forming section and a second end (an opposite end) of the first sheet member 1. In this regard, it is not necessary to set the distance between the outer periphery of the accommodation-hole forming section and the first end to be wider than the distance between the outer periphery of the accommodation-hole section. The first sheet member 1 also has an elongated hole 6 located closer to the accommodation-hole section than to the first end 5. The elongated hole 6 except for some part thereof is covered by a cover 8 that has cuts 7 around its outer periphery. The elongated hole 6 may be entirely covered by the cover. In this embodiment, the elongated hole 6 is located away from the first end by about 3 cm so as to make a child hard to reach the cover 8. That is, when a child tries to reach the elongated hole 6 with a finger of one hand while holding the PTP case, his or her short finger is not enough to reach the elongated hole 6 from the first end.

In FIG. 3, a second sheet member 9, which extends from the first sheet member 1 via a fold line 10, has a take-out hole forming section with take-out holes 11 for taking out the pills 3 from the PTP 2, which holes are located so as to respectively face the corresponding accommodation holes 4 of the first sheet member 1 when the first sheet member 1 has been folded onto the second sheet member 9. The second sheet member 9 also has an elongated hole 12 located so as to face the elongated hole 6 of the first sheet member 1 when the first sheet member 1 has been folded onto the second sheet member 9. Cut-away portions 13, 14 are respectively formed in the each-other facing ends of the first and second sheet members 1, 9. Seal sections 15 are formed on the second sheet member 9 along a first end (a right hand side end in FIG. 3), a second end (a left hand side end in FIG. 3) and a third end (a lower end in FIG. 3), through which the first sheet member 1 and the second sheet member 9 are bonded together. A cover sheet member 16 extends from the second end of the second sheet member 9 via a hinge strip 17.

A blocking sheet member 18 extends from the first end of the second sheet member 9 via a fold line 19 and a connection strip 20 so as to be placed between the second sheet member 9 and the PTP 2 when folded, as illustrated in FIG. 3. Cuts 21 are intermittently formed between the blocking sheet member 18 and the connection strip 20 so that the blocking sheet member 18 can be separated away from the connection strip 18 therethrough. The blocking sheet member 18 has a corrugated section 22 that is located adjacent to the cuts and formed by embossing, with ridges and troughs extending in the width direction thereof (a horizontal direction in FIG. 3). The blocking sheet member 18 also has plural holes 23 that are formed adjacent to the corrugated section 22 and have substantially the same shape as that of the accommodation holes 4 and the take-out holes 11. The plural holes 23 are located so as not to be matched in position to the accommodation holes 4 and the take-out holes 11 when the blocking sheet member 18 has been folded onto the second sheet member 9 along the fold line 19, thereby closing the take-out holes 11 in the folded state. The blocking sheet member 18 is sized and dimensioned so as to have the seal sections 15 of the second sheet member 9 respectively located outside of a first end 24 (a right hand side end in FIG. 3) and a second end 25 (a lower end in FIG. 3) of the blocking sheet member 18, and have a third end thereof (an upper end in FIG. 3) located so as not to be exposed to the outside through the cut-away portions 13, 14, when the blocking sheet member 18 has been folded onto the second sheet member 9. Since a seal section is not formed on an upper end of the second sheet member 9, the blocking sheet member 18, once it has been torn off from the connection strip 20, can be slid in the vertical direction along the second sheet member 9 and the PTP 2 when in use, as illustrated in FIG. 2.

According to the thus arranged PTP case, the take-out holes 11 are closed by the blocking sheet member 18, and the blocking sheet member 18 are secured to the second sheet member 9 via the connection strip 20 so as not to be slid. This arrangement reduces the possibility of falling-out of the pills 3 from the PTP 2 during the transportation.

Now, the description will be made for the manner of taking out the pills 3 from the PTP case when in use. As illustrated in FIG. 2, with the cover sheet member 16 kept open, the cover 8 is torn off from the first sheet member 1 through cuts 7 so as to open the elongated hole 6. Then, the blocking sheet member 18 is moved in the direction of arrow A by pressing the corrugated section 22 of the blocking sheet member 18 exposed to the outside through the elongated hole 6 of the first sheet member 1 and the elongated hole 12 of the second sheet member 9 with finger from the front and rear sides. This sliding action causes the blocking sheet member 18 to be torn off and separated from the connection strip 29, thus allowing the blocking sheet member 18 to be slid along the second sheet member 9. The corrugated section with the ridges and troughs act as a slippage prevention means so that the blocking sheet member 18 can be more easily slid.

According to the PTP case of this embodiment, it is necessary to open the elongated hole 6 by tearing off the cover 8 along the cuts from the first sheet member 1 in order to slide the blocking sheet member 18 and take out the pills 3 from the PTP 2. This means that as long as the elongated hole 6 is held in closed state by the cover 9, any illegal action applied onto the pills 3 in an attempt to falsely replace the pills 3 with improper pills or medicines, or the like can be prevented. Thus, the pills 3 can be kept in secure storage under control.

Once the blocking sheet member 18 is torn off from the connection strip 20, as described above, it is slid until the holes 23 of the blocking sheet member 18 are respectively matched in position to the take-out holes 11. Once they are matched in position, an end (an upper end in FIG. 2) of the blocking sheet member 18 is exposed to the outside through the cut-away portions 13, 14 of the first and second sheet members 1, 9. While keeping this position, a pressure is applied onto the pills 9 through the blisters, thereby rupturing an aluminum foil or paper sheet attached to a sheet made of typically a plastic material with the blisters formed therein. Thus, the pills 3 can be taken out from the PTP 2.

When the PTP case is set so as to prevent the pills 3 from being taken out therefrom, the reverse operation is carried out. That is, the blocking sheet member 18 is slid to the original position by applying pressure onto the areas thereof exposed to the outside through the elongated holes 6, 12 with finger, or the upper end of the blocking sheet member 18 exposed to the outside through the cut-away portions 13, 14 is pressed inwardly, thereby sliding the blocking sheet member 18 back to the original position. Thus, the take-out holes 11 of the second sheet member 9 is closed by the blocking sheet member 18.

With the take-out holes 11 held in closed state by the blocking sheet member 18, the pills 3 can be securely blocked from being taken out from the PTP case, thus achieving prevention of accidental taking-out of the pills 3 by a child or careless adult. In addition, a child hardly holds and slides the blocking sheet member 18 through the elongated holes 6, 12 of the first and second sheet members 1, 9, since these holes are located with a relatively large distance (about 3 cm) from the first end of each of the first and second sheet members 1, 9. As a result, it is possible to prevent accidental swallowing of the pills 3 by a child and keep the pills 3 in secure and proper storage under control by a parent or responsible person.

The first and blocking sheet members 1, 18 are respectively in the form of extensions of the second sheet member 9. Accordingly, only the folding of these sheet members 1, 18 onto the second sheet member 9 is enough to assemble the PTP case. This contributes to ease of assembling and improved efficiency in assembling.

In the above embodiment, the blocking sheet member 18 is designed to be able to be torn off from the connection strip 20 by the sliding action of the blocking sheet member 18 relative to the connection strip 20 by holding the exposed areas of the blocking sheet member 18 through the elongated holes 6, 12 with fingers of one hand while holding the PTP case with fingers of the other hand, and thus being able to be slid to the position at which the holes 23 of the blocking sheet member 18 are respectively matched in position to the take-out holes 11, while keeping the take-out holes 11 of the second sheet member 9 in closed state before use. Accordingly, a desirable effect of securely preventing unintentional slide of the blocking sheet member 18 can be produced. In this regard, the blocking sheet member 18 may be formed separately or independently of the second sheet member 9. Also, an arrangement without the connection strip 20 is also possible by for example forming a sealed portion between the first and second sheet members 1, 9 extending parallel to their first ends, allowing the sealed portion to act as a guide, along which the blocking sheet member 18 is slid. Also, the first sheet member 1 and the cover sheet member 16 each may be formed independently of the second sheet member 9.

The elongated holes 6, 12 of the first and second sheet members 1, 9, which are preferably located with a relatively large distance from the first ends of the first and second sheet members 1, 9. That is, a child or the like is hardly to reach the elongated holes 6, 12 of the first and second sheet members 1, 9 with fingers of one hand while holding the PTP case with fingers of another hand. This holding manner is usually essential in order to slide the blocking sheet member 18 in the first and second sheet members 1, 9. However, this positioning of the elongated holes 18 are not necessarily limited to the arrangement of the above embodiment. The distance between the elongated holes 6, 12 and the first ends of the first and second sheet members 1, 9 may be varied or shortened according to needs and circumstances.

In the above embodiment, the cover 8 is provided to the elongated hole 6 of the first sheet member 1. This is not essential and therefore it is possible to provide the cover 8 alternatively to the elongated hole 12 of the second sheet member 9, or provide covers to both the elongated holes 6, 12. Or, the elongated holes 6, 12 may be provided with no covers.

It is not necessary to provide two cut-away portions 13, 14 in the first and second sheet members 1, 9. Either one of the cut-away portions 13, 14 may be provided. Or, the first and second sheet members 1, 9 may be provided with no cut-away portions 13, 14.

Also, the cover sheet member 16, the corrugated section 22 of the blocking sheet member 18 or the like are not essential in the present invention.

The accommodation holes, the take-out holes 11 and the holes 23 may be varied in shape, position or the like within the intended scope of the present invention.

A PTP, to which the PTP case of the present invention is applicable, is not necessarily limited to the PTP 2 of the above embodiment. That is, the PTP case of the present invention is widely applicable to such as a PTP having a different arrangement, such as a PTP provided with a single blister with one ore more pills therein.

This specification is by no means intended to restrict the present invention to the preferred embodiments set forth therein. Various modifications to the PTP case, as described herein, may be made by those skilled in the art without departing from the spirit and scope of the present invention as defined in the appended claims.

What is claimed is:

1. A case for a press-through package with at least one blister with one or more pills therein comprising;

a first sheet member having at least one accommodation hole for accommodation of said at least one blister;

a second sheet member having at least one take-out hole located corresponding to said at least one accommodation hole of said first sheet member, in which said press-through package is placed between said first and second sheet members so that said one or more pills is taken out from said at least one blister through said at least one take-out hole;

a blocking sheet member disposed between said press-through package and said second sheet member in such a manner as to be slidable along said press-through package and said second sheet member between an opening position at which said at least one take-out hole is exposed to the outside, and a closing position at which said at least one take-out hole is closed by said blocking sheet member; and said first and second sheet members respectively having elongated holes located corresponding to each other so as to make said blocking sheet member to the outside through said elongated holes.

2. The case for a press-through package according to claim 1, wherein:

the distance between an outer periphery of an accommodation-hole forming section with said at least one accommodation hole therein and a first end of said first sheet member is set to be wide;

the distance between an outer periphery of a take-out hole forming section with said at least one take-out hole therein and a first end of said second sheet member is set to be wide;

said elongated hole of said first sheet member is located closer to said outer periphery of said accommodation-hole forming section than to said first end of said first sheet member; and said elongated hole of said second sheet member is located closer to said outer periphery of said take-out hole forming section than to said first end of said second sheet member.

3. The case for a press-through package according to claim 1, wherein a cover is detachably attached to any one of said first and second sheet members so as to partially or entirely cover a corresponding one of said elongated holes.

4. The case for a press-through package according to claim 1, wherein covers are detachably attached respectively to said first and second sheet members so as to partially or entirely cover said elongated holes.

5. The case for a press-through package according to claim 1, wherein at least one of said first and second sheet members has a cut-away portion, through which an end of said blocking sheet member in the sliding direction thereof is exposed to the outside, when said blocking sheet member is slid to said opening position.

6. The case for a press-through package according to claim 1, wherein said blocking sheet member has a corrugated section with ridges and troughs extending in a direction substantially crossing a direction in which said blocking sheet member is slid between said opening position and said closing position, said corrugated section being located so as to be exposed to the outside through said elongated holes of said first and second sheet members.

* * * * *